US005536331A

United States Patent [19]

Korsch

[11] Patent Number: 5,536,331

[45] Date of Patent: Jul. 16, 1996

[54] PROCESS FOR CLEANING TABLETTING, PAN-COATING AND GRANULATING MACHINES, ESPECIALLY ROTARY TABLETTING PRESSES

[75] Inventor: Wolfgang Korsch, Berlin, Germany

[73] Assignee: Korsch Pressen GmbH, Berlin, Germany

[21] Appl. No.: 283,946

[22] Filed: Aug. 1, 1994

[30] Foreign Application Priority Data

Jul. 31, 1993 [DE] Germany ..... 43 26 239.2

[51] Int. Cl.[6] ..... B08B 5/04

[52] U.S. Cl. ..... 134/21; 134/2; 134/18; 134/22.1; 134/22.19; 134/24; 134/29; 134/30; 134/31; 134/37

[58] Field of Search ..... 134/22.1, 21, 26, 134/2, 10, 11, 23, 31, 33, 40

[56] References Cited

U.S. PATENT DOCUMENTS

| | | | |
|---|---|---|---|
| 4,108,338 | 8/1978 | Howland et al. | 222/286 |
| 4,639,383 | 1/1987 | Casey | 427/213 |
| 5,137,581 | 8/1992 | Takahashi | 134/21 |
| 5,180,438 | 1/1993 | Hockh et al. | 134/21 |
| 5,203,927 | 4/1993 | Yoshida et al. . | |

FOREIGN PATENT DOCUMENTS

| | | |
|---|---|---|
| 3715168 | 12/1988 | Germany . |
| 3814014 | 11/1989 | Germany . |
| 4138432 | 2/1993 | Germany . |
| 1196288 | 8/1989 | Japan . |
| 3193239 | 8/1991 | Japan . |
| 6040729 | 2/1994 | Japan . |

*Primary Examiner*—Jan H. Silbaugh
*Assistant Examiner*—Robin S. Gray
*Attorney, Agent, or Firm*—McGlew and Tuttle

[57] ABSTRACT

A process for cleaning tabletting, pan-coating and granulating machines, especially rotary tabletting presses, with a treatment chamber including at least the rotor. To ensure the complete removal of the liquid residues from the treatment chamber and from the components left in the treatment chamber, especially of the rotor of a rotary tabletting press using small amounts of cleaning and rinsing liquids, a cleaning agent and a rinsing agent are sprayed within the treatment chamber and then drained off. All openings of the treatment chamber are then closed, and a vacuum of about 0.1 to 0.2 bar (absolute pressure) is generated within the sealed treatment chamber. The vacuum drains the residual liquid from all holes and joints of the rotor and from the treatment chamber.

12 Claims, 1 Drawing Sheet

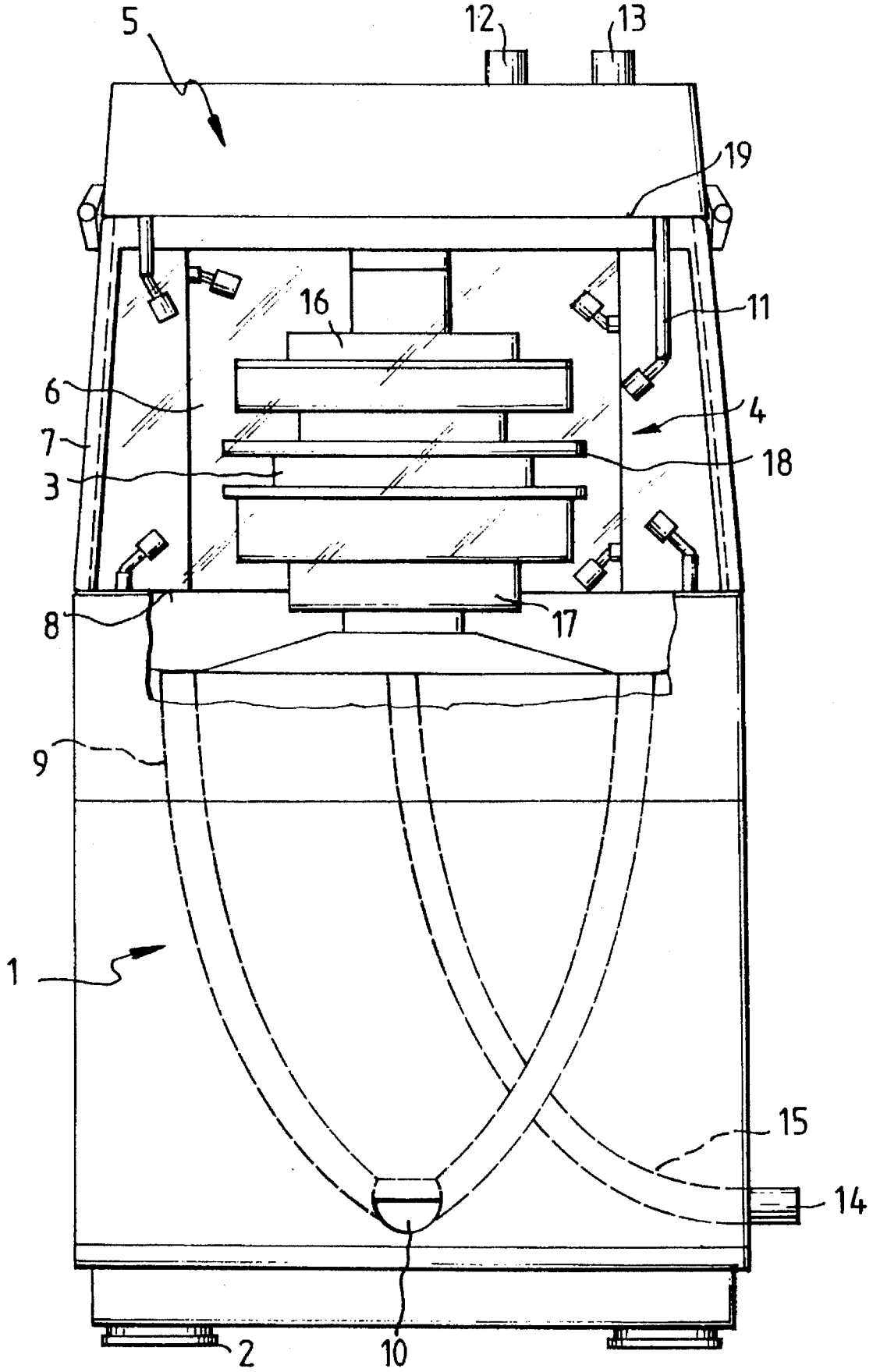
5
12
13
19
16
11
6
4
7
18
3
8
17
9
1
15
14
2
10

PROCESS FOR CLEANING TABLETTING, PAN-COATING AND GRANULATING MACHINES, ESPECIALLY ROTARY TABLETTING PRESSES

FIELD OF THE INVENTION

The present invention pertains to a process and a device for cleaning tabletting, pan-coating and granulating machines, especially rotary tabletting presses with a treatment chamber enclosing at least the rotor.

BACKGROUND OF THE INVENTION

A rotary tabletting press, which is provided with a treatment chamber which includes at least the rotor and is flooded with a cleaning liquid, and in which the dirt particles of the rotor are repelled by means of ultrasound, has been known from *Pharmaceutical Cosmetic Equipment,* January-February 1988 issue. The liquid loaded with the dirt particles is drained off after a predetermined treatment time. The disadvantage is that the lightweight dirt particles float on the surface of the liquid and leave a dirt film on the surfaces of the rotor and of the treatment chamber when the liquid is drained off, and this dirt film cannot be completely removed even after repeated floodings of the treatment chamber. Another disadvantage is the subsequent drying of the rotor components located within the treatment chamber; in particular, residues of liquid are not completely removed from holes and joints of the rotor.

SUMMARY AND OBJECTS OF THE INVENTION

The primary object of the present invention is therefore to provide a process and a device for cleaning tabletting, pan-coating and granulating machines, especially a rotary tabletting press, which ensure complete removal of the liquid residues from the treatment chamber and from the components, especially of a rotary tabletting press, using small amounts of cleaning liquid.

To accomplish this task, the process according to the present invention provides for consecutive spraying and subsequent draining off of a cleaning agent and a rinsing agent within the treatment chamber, and for the subsequent closing of all openings of the treatment chamber, and of generating a vacuum, especially about 0.1 to 0.2 bar, within the now encapsulated treatment chamber. The device according to the present invention provides for spray heads for spraying the cleaning agent and the rinsing agent within the treatment chamber, for connections for draining off the cleaning agent and the rinsing agent, and for means for closing openings of the treatment chamber and for a vacuum device that can be connected to the said treatment chamber in order to generate a vacuum of about 0.1 to 0.2 bar (absolute pressure) within the now encapsulated (sealed) treatment chamber. The process according to the present invention and the device according to the present invention make it possible to clean especially the components of the rotor of a rotary tabletting press located in the treatment chamber using small amounts of cleaning agent and rinsing agent, and to completely remove the cleaning agent and the rinsing agent used by applying the vacuum of ca. 0.1 to 0.2 bar (absolute pressure) within the encapsulated treatment chamber. The generation of vacuum within the treatment chamber makes it possible to dry the components of the rotary tabletting press located within the treatment chamber even in inaccessible openings and joints of the rotor.

Residual amounts of liquid are drained off by means of the vacuum and are removed via the vacuum connection.

Other advantageous embodiments of the present invention are discussed below. It is especially advantageous for the cleaning and rinsing processes to be carried out at a temperature above room temperature, preferably between 40° C. and 70° C. The rotor is advantageously rotated at a low speed in the process. Finally, a hot steam treatment of the rotor within the treatment chamber may be performed prior to the application of the vacuum, while sterilization conditions are set for a defined period of time.

The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which a preferred embodiment of the invention is illustrated.

BRIEF DESCRIPTION OF THE DRAWINGS

In the drawings:

The only FIGURE shows a side view of a rotary tabletting press with a rotor located within the treatment chamber, with certain components having been removed beforehand.

DESCRIPTION OF THE PREFERRED EMBODIMENTS

The rotary tabletting press comprises a machine base 1 standing on feet 2 for accommodating the mount and the drive elements of the rotor 3. The rotor 3 is arranged within a treatment chamber 4 arranged above the said machine base 1, and it is provided with another mount in the head piece 5. The treatment chamber 4 is surrounded by four window panes 6, which enclose the rotor 3 and are fastened to four props 7 supporting the head piece 5 on the machine base 1. The machine base 1 comprises a cover plate 8, not shown in detail, whose surface has a slope of 3 to 4° to outlets, to which drain tubes 9 leading to a common drain pipe connection 10 are connected. A plurality of high-pressure spray nozzles 11, which are directed from the top and from the bottom toward the rotor 3 and into the interior space of the said treatment chamber 4 at different slope angles, are arranged distributed within the treatment chamber 4. A feed pipe connection 12 for cleaning agent and rinsing agent, as well as a feed pipe connection 13 for hot steam, which lead, via channels (not shown in detail) in the head piece 5, into the said treatment chamber 4, in which the rotor 3 is mounted, are arranged in the head piece 5. Finally, a connecting branch 14, which is connected to the treatment chamber 4 via a vacuum-proof tube 15, and to which a vacuum device (not shown) for generating a vacuum of 0.1 to 0.2 bar within the treatment chamber 4 can be connected, is arranged on the machine base 1.

Individual components, especially filling shoes, the upper die and the lower die, as well as their cams and pressure rollers, are removed before the cleaning of the components located in the treatment chamber 4 is performed. The said rotor 3, which remains within the treatment chamber 4, with its bell-shaped cam 16, its cam support 17, and the die plate 18, is now first subjected within the treatment chamber 4 to a first cleaning step, in which a cleaning agent is sprayed by means of the high-pressure nozzles 11 against the rotor 3 and its components that have been left in place, while the rotor 3 slowly rotates. The cleaning agent is fed in via the feed pipe connection 12. The used cleaning agent is subsequently removed via the drain tubes 9 and the drain pipe connection 10. The cleaning agent may be filtered and returned for use.

Rinsing of the treatment chamber 4 and of the rotor 3 rotating in it is performed in the next cleaning step, while a rinsing agent, especially distilled water, is fed in via the feed pipe connection 12, and it is sprayed via the said high-pressure spray nozzles 11 against the said rotor 3. The rinsing agent is also subsequently drained off via the drain pipe connection 10 and may be filtered on a filter and reused.

All openings of the said treatment chamber 4, especially the drain pipe connection 10, the feed pipe connection 12 for cleaning agent and rinsing agent, as well as the feed pipe connection 13 for hot steam, and the drain pipe connection 10, are then hermetically sealed. The said window panes 6, the cover plate 8 of the machine base 1, and the base plate of the head piece 5 surround the hermetically encapsulated treatment chamber 4. A vacuum of ca. 0.1 to 0.2 bar relative to absolute pressure is subsequently generated within the now hermetically encapsulated treatment chamber 4 via the connecting branch 14 and the vacuum device connected to it, as a result of which the entire residual liquid still adhering to the window panes 6 within the treatment chamber 4, and especially the residual liquid remaining within the holes and joints of the rotor 3, are completely removed. The residual water evaporates at room temperature and is drained off via the connecting branch 24 for the vacuum device.

The first and second cleaning steps are preferably carried out at temperatures above room temperature, especially at temperatures between 40° C. and 70° C. As a result, water of condensation is prevented from forming on opening the treatment chamber 4.

The process makes it possible to maintain the clean air conditions for the preparation of foods and luxury goods according to the Good Manufacturing Practice (GMP) and Food and Drug Administration (FDA) specifications.

The said high-pressure spray nozzles 11 may also be designed as E-shaped spray heads, in which case a high-pressure spray nozzle each is arranged at the ends of the horizontal webs of the E-shaped spray heads, and these spray nozzles surround the die plate 18 on both sides and spray directly into the holes of the dies.

I claim:

1. A process for cleaning rotary tabletting presses and coating and granulating machines with at least one treatment chamber enclosing a rotor, the process comprising the steps of:

providing fluid supply and fluid draining openings in the treatment chamber for supplying fluid and for draining fluid;

spraying detergent within the treatment chamber by supplying said detergent through said fluid supply openings in the treatment chamber;

draining off said detergent after maintaining said detergent within said treatment chamber for a reaction time, by a draining said detergent through said fluid draining openings;

spraying a rinsing agent into the treatment chamber by supplying said rinsing agent through said fluid supply openings;

draining off said rinsing agent from the treatment chamber by draining said rinsing agent through said fluid draining openings;

subsequent to said step of draining off said rinsing agent, closing said fluid supply and fluid draining openings;

providing a vacuum connection in said treatment chamber; and generating a vacuum in said treatment chamber through said vacuum connection while said fluid supply and fluid draining openings are closed to thereby remove residual fluid from inaccessible openings and joints of the rotor and said treatment chamber.

2. A process according to claim 1 wherein said vacuum is about 0.1 to 0.2 bar of absolute pressure.

3. A process according to claim 1, wherein a temperature of between about 40° C.–70° C. is maintained within said treatment chamber during said step of spraying said detergent and during said step of spraying said rinsing agent.

4. A process according to claim 1 wherein said rotor is rotated during said step of spraying said detergent.

5. A process according to claim 1, further comprising the step of introducing hot steam into said treatment chamber, after said step of closing said fluid supply and fluid draining openings and prior to said step of generating said vacuum, said hot steam being introduced into said treatment chamber while said fluid supply and fluid draining openings of said treatment chamber are closed, said hot steam being maintained at a sterilization temperature for a sterilization time period.

6. A process according to claim 2, wherein the treatment chamber is maintained at a temperature of about 40° C.– 70° C. during said step of spraying said detergent and during said step of spraying said rinsing agent.

7. A process for cleaning a treatment chamber enclosing a rotor, comprising the steps of:

providing fluid supply and fluid draining openings in the treatment chamber for supplying fluid and for draining fluid;

maintaining the rotor within the treatment chamber for the further steps of spraying detergent within the treatment chamber by supplying said detergent through said fluid supply openings in the treatment chamber;

draining said detergent from said treatment chamber after maintaining said detergent within said treatment chamber for a reaction time, by draining said detergent through said fluid draining openings;

spraying a rinsing agent into the treatment chamber by supplying said rinsing agent through said fluid supply openings;

draining said rinsing agent from the treatment chamber by draining said rinsing agent through said fluid draining openings;

subsequent to said step of draining said rinsing agent, hermetically sealing said fluid supply and fluid draining openings;

providing a vacuum connection in said treatment chamber; and generating a vacuum in said treatment chamber through said vacuum connection while said fluid supply and fluid draining openings are hermetically sealed to thereby remove residual fluid from inaccessible openings and joints of the rotor and said treatment chamber.

8. A process according to claim 7, wherein said vacuum is about 0.1 to 0.2 bar of absolute pressure.

9. A process according to claim 7, wherein a temperature of between about 40° C.–70° C. is maintained within said treatment chamber during said step of spraying said detergent and during said step of spraying said rinsing agent.

10. A process according to claim 7, wherein said rotor is rotated during said step of spraying said detergent.

11. A process according to claim 7, further comprising the step of introducing hot steam into said treatment chamber, after said step of closing said fluid supply and fluid draining openings and prior to said step of generating said vacuum, said hot steam being introduced while said fluid supply and fluid draining openings of said treatment chamber are hermetically sealed, said hot steam being maintained at a sterilization temperature for a sterilization time period.

12. A process according to claim 7, wherein the treatment chamber is maintained at a temperature of about 40° C.–70° C. during said step of spraying said detergent and during said step of spraying said rinsing agent.

* * * * *